US009126711B2

(12) United States Patent
Hermosillo et al.

(10) Patent No.: US 9,126,711 B2
(45) Date of Patent: Sep. 8, 2015

(54) ARTICLE-TRANSPORT CONTAINER

(71) Applicant: TIN Inc., Memphis, TN (US)

(72) Inventors: Ignacio Padilla Hermosillo, Juriquilla (MX); Michael B McLeod, Romeoville, IL (US); Ramon Ulises Cota Soto, Guasave (MX)

(73) Assignee: TIN INC., Memphis, TN (US)

( * ) Notice: Subject to any disclaimer, the term of this patent is extended or adjusted under 35 U.S.C. 154(b) by 15 days.

(21) Appl. No.: 13/743,821

(22) Filed: Jan. 17, 2013

(65) Prior Publication Data

US 2013/0186948 A1 Jul. 25, 2013

Related U.S. Application Data

(60) Provisional application No. 61/590,227, filed on Jan. 24, 2012.

(51) Int. Cl.

| | |
|---|---|
| ***B65D 21/028*** | (2006.01) |
| ***B65D 5/00*** | (2006.01) |
| ***B65D 5/42*** | (2006.01) |
| ***B65D 5/44*** | (2006.01) |
| ***B65D 5/20*** | (2006.01) |

(52) U.S. Cl.

CPC ..... *B65D 5/0045* (2013.01); *B65D 5/003* (2013.01); *B65D 5/2033* (2013.01); *B65D 5/42* (2013.01); *B65D 5/4295* (2013.01); *B65D 5/443* (2013.01)

(58) Field of Classification Search

USPC ..... 229/109, 170, 171, 174, 191, 915, 918, 229/919

See application file for complete search history.

(56) References Cited

U.S. PATENT DOCUMENTS

| | | | | |
|---|---|---|---|---|
| 667,112 | A | 1/1901 | Beers | |
| 2,147,563 | A * | 2/1939 | Turner | 229/109 |
| 2,603,404 | A | 7/1952 | Eldredge | |
| 2,868,430 | A | 1/1959 | Hamilton | |
| 3,118,591 | A | 1/1964 | Allard | |
| 3,268,147 | A | 8/1966 | Burger | |
| 3,310,219 | A | 3/1967 | Dlugopolski | |
| 3,545,666 | A | 12/1970 | Visvydas | |
| 3,704,823 | A | 12/1972 | Howe | |
| 3,810,574 | A | 5/1974 | Gardner | |
| 3,871,570 | A | 3/1975 | Garmon | |

(Continued)

FOREIGN PATENT DOCUMENTS

| | | | | |
|---|---|---|---|---|
| EP | 790189 A1 * | 8/1997 | ..... | B65D 5/0045 |
| EP | 1215125 A1 * | 6/2002 | ..... | B65D 5/0025 |

(Continued)

*Primary Examiner* — Gary Elkins

(74) *Attorney, Agent, or Firm* — Matthew M. Eslami

(57) ABSTRACT

An article-transport container comprises a floor having a respective left-side and right-side closures that are foldably joined thereto. A front end wall is foldably joined to the floor and to the respective left-side and right-side closures. A rear end wall is foldably joined to the floor and to the respective left-side and right-side closures and at least one tri-layers corner cooperate with the respective left-side and right-side closures to define an interior region adapted to receive articles therein. The least one tri-layer corner includes respective outer and inner layers and a medical layer which is sandwiched between the respective outer and inner layers and a medical layer which is sandwiched between the respective outer and inner layers to enhance stacking strength of the container while minimizing scarps produced during construction of the container.

11 Claims, 7 Drawing Sheets

(56) References Cited

U.S. PATENT DOCUMENTS

| | | | | | |
|---|---|---|---|---|---|
| 4,537,344 | A | | 8/1985 | Thomas | |
| 4,613,045 | A | | 9/1986 | Watson | |
| 4,792,084 | A | | 12/1988 | Dreeszen | |
| 4,883,221 | A | | 11/1989 | Brundage | |
| 4,911,355 | A | | 3/1990 | Bannister | |
| 5,016,814 | A | * | 5/1991 | Fullerton | 229/196 |
| 5,052,615 | A | | 10/1991 | Ott et al. | |
| 5,163,609 | A | | 11/1992 | Muise, Jr. | |
| 5,289,970 | A | | 3/1994 | McClure | |
| 5,330,094 | A | | 7/1994 | Mertz | |
| 5,395,043 | A | | 3/1995 | Bacques et al. | |
| 5,560,539 | A | | 10/1996 | Baxter | |
| 5,752,648 | A | | 5/1998 | Quaintance | |
| 5,913,474 | A | * | 6/1999 | Chu | 229/915 |
| 5,979,746 | A | | 11/1999 | McLeod et al. | |
| 6,286,753 | B1 | * | 9/2001 | Jackson et al. | 229/174 |
| 6,302,323 | B1 | | 10/2001 | Southwell | |
| 6,394,742 | B1 | | 5/2002 | Buscema | |
| 6,481,619 | B1 | * | 11/2002 | Jackson | 229/170 |
| 6,513,705 | B1 | | 2/2003 | Sheffer | |
| 6,598,785 | B2 | | 7/2003 | Quaintance | |
| 6,899,266 | B2 | | 5/2005 | Conway | |
| 7,017,798 | B2 | | 3/2006 | Pope et al. | |
| 7,470,226 | B1 | | 12/2008 | Herrin | |
| 7,484,655 | B2 | | 2/2009 | McLeod | |
| 7,665,654 | B2 | | 2/2010 | McLeod | |
| 7,850,064 | B2 | | 12/2010 | McLeod | |
| 8,091,770 | B2 | | 1/2012 | McLeod | |
| 8,251,276 | B2 | | 8/2012 | McLeod | |
| 8,408,452 | B2 | * | 4/2013 | Churvis et al. | 229/109 |
| 2004/0149815 | A1 | | 8/2004 | Holdsworth et al. | |
| 2005/0145687 | A1 | | 7/2005 | Conway | |
| 2005/0236466 | A1 | | 10/2005 | McLeod | |
| 2006/0213958 | A1 | | 9/2006 | Valenzuela et al. | |
| 2006/0231603 | A1 | | 10/2006 | McLeod | |
| 2009/0145955 | A1 | | 6/2009 | McLeod | |
| 2009/0280973 | A1 | | 11/2009 | Graham et al. | |
| 2010/0219232 | A1 | * | 9/2010 | Smith | 229/108 |
| 2013/0048704 | A1 | * | 2/2013 | Lewis et al. | 229/190 |
| 2014/0084047 | A1 | | 3/2014 | McLeod | |

FOREIGN PATENT DOCUMENTS

| | | | | | |
|---|---|---|---|---|---|
| EP | 1764311 | | | 3/2007 | |
| FR | 2669301 | | | 5/1992 | |
| GB | 971565 | A | * | 9/1964 | B65D 5/002 |
| GB | 2157659 | A | * | 10/1985 | B65D 5/0045 |
| GB | 2229426 | | | 9/1990 | |
| GB | 2300179 | A | * | 10/1996 | B65D 5/0045 |
| WO | WO-2013/090612 | A1 | * | 6/2013 | B65D 5/443 |
| WO | 2013112348 | | | 8/2013 | |

* cited by examiner

ARTICLE-TRANSPORT CONTAINER

CROSS REFERENCE TO RELATED APPLICATIONS

This application claims priority to U.S. provisional patent application Ser. No. 61/590,227, filed on 24 Jan. 2012, which is hereby incorporated hereinto by reference as if fully restated herein.

FIELD OF THE INVENTION

The present invention relates containers and/or trays and, and particularly to containers and/or trays and made of paperboard. More particularly, the present disclosure relates to a sturdy container or tray made of corrugated material and configured to contain food or other items.

BACKGROUND OF THE INVENTION

Containers made of paperboard, i.e., corrugated cardboard, are commonly used in the produce industry to pack, store and ship fresh produce. These containers typically have a bottom, opposite side walls, opposite end walls, and an open or partially open top, and when filled with fresh produce are placed on a pallet for shipping and handling. These containers have an inside minor flap which is divided, and shared with an outside full depth flap, to provide four additional corners in the same amount of material as other shipping containers. To enable the containers to be stacked on one another in stable relationship, they must have sufficient structural strength and rigidity to withstand the stacking forces. Thus, the side and/or end walls of the containers are usually constructed with multiple thicknesses, and/or additional reinforcing structure also may be provided, and the flutes of the corrugated material are typically arranged to extend vertically.

There is need for a paperboard container that is stackable, structurally rigid, and easy to set-up, reliably remains in set-up condition, and requires a minimum amount of material in its construction.

SUMMARY OF THE INVENTION

The present octagonal flush end container/tray is developed to address shallow tray design and yet could still benefit from eight corners cross laminated design. The container/tray has an inner minor flap feature that incorporates a mitered-bridging portion to have enough material to affect a seal and result in a strong container/tray. In the present invention, the top flap and outer flaps move inward so that the exterior wrap around corner mated with the mitered portion, rather than the flat end of the container/tray. This results in an oversized slot in the shape of a rhombus rather than rectangular. The present octagonal flush end container/tray did not have the overlapping corner flaps on the end, so that some of the material lying in the area in between (shaped slot) might be used in the construction of the container/tray rather than being discarded as scrap. Utilization of this material reduces its waste at the box plant and provides the customer with more of the material they are purchasing in the area of the blank. In addition to the improved blank utilization, it was found that adding some of the material back to the large slotted area improves stacking strength since this material is sandwiched between the inner anchor flap bridging section and the canopy auxiliary flap. Compression test comparing two octagonal containers/trays found that the octagonal container/tray with the sandwiching flap bridging section and outer auxiliary flap has at least between 8 to 12 percent higher stacking strength than the octagonal container/tray without the aforementioned configuration.

An article-transport container or tray is adapted to transport food or other articles from one site to another. The container includes a floor, a left-side closure, a right-side closure, a front end wall coupled to the floor and to the two closures, and a rear end wall coupled to the floor and to the two closures. These walls and closures cooperate to form an interior article-receiving region.

In illustrative embodiments, the container further includes a first tri-layer corner formed between the front end wall and the right-side closure. The first tri-layer corner includes an inner layer coupled to the front end wall, a medial layer formed from a first portion of the right-side closure, and an outer layer formed from a second portion of the right-side closure. The medial layer is positioned to lie between the inner and outer layers and is configured to provide means for interconnecting the outer layer and the inner layer to cause stacking strength of the container to be improved while minimizing scrap produced during blank forming so that costs associated with producing the container are minimized.

In illustrative embodiments, the medial layer includes corrugation. The corrugation is arranged to extend horizontally parallel to the floor of the container.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 is a perspective view of the blank of FIG. 3 being folded to form the container showing that the rear end strip is folded about a rear-end fold line and at the same time folding both first and second rear anchor flaps included in the rear end strip about associated anchor-flap fold lines toward the octagon-shaped floor so that the left and right side closures can be folded upwardly as suggested in FIG. 5;

FIG. 5 is a view similar to FIG. 4 showing continued forming of the container by folding the left side closure about the left-side fold line so that a portion of the second rear anchor flap is between a left side wall included in the left side panel and an interior region of the container and by folding the right side closure about a right-side fold line so that a portion of the first rear anchor flap is between the right side wall and the interior region of the container;

FIG. 6 is an enlarged partial view of the first tri-layer corner of the container of FIG. 5 showing continued forming of the container by folding the right side wall about the right side fold line so that the right side wall mates with the right corner tab of the front end strip and suggesting that the first wall anchor flap included in the inner strip mates with the right corner bridge of the front end strip as suggested in FIG. 7;

FIG. 7 is a view similar to FIG. 6 showing continued forming of the container by folding the first primary and auxiliary canopy anchor flaps about a first primary flap fold line toward the floor to cause the first primary canopy anchor flap to mate with the front end wall as suggested in FIG. 8;

FIG. 8 is a view similar to FIG. 7 showing continued forming of the container by folding the first auxiliary canopy anchor flap about a first auxiliary flap fold line toward the right wall anchor flap to mate with the right wall anchor flap as suggested in FIG. 9;

FIG. 9 is a view similar to FIG. 8 showing completed forming of the container and formation of the first tri-layer corner as a result;

FIG. 10 shows a portion of a blank in accordance with a second embodiment of the present disclosure;

FIG. 11 is a view similar to FIG. 9 following folding of a first auxiliary canopy anchor flap towards a first right wall anchor flap trapping the first right wall anchor flap between the first auxiliary canopy anchor flap and a right corner bridge causing a first tri-layer corner to be established; and FIG. 12 is a section view taken along line 12-12 of FIG. 11 showing that the front-right tri-layer corner included in the article-transport container includes an outer layer formed by the first auxiliary canopy anchor flap, a spaced-apart inner layer formed by the right corner bridge, and a medial layer formed by the first right wall anchor flap and showing that the first right wall anchor flap is arranged to lie between the inner and outer layers and to extend fully between the right side wall and the front end wall.

DETAILED DESCRIPTION OF THE INVENTION

Figure 1:
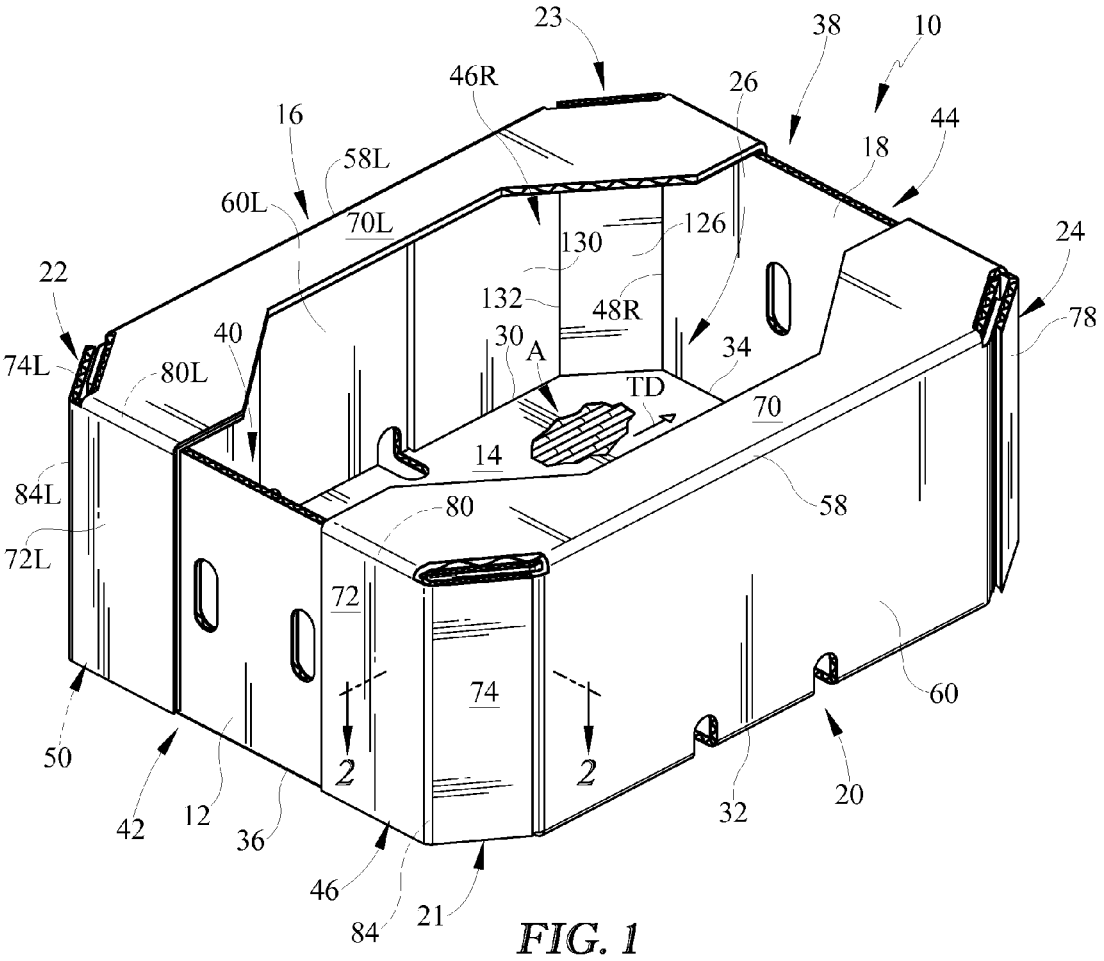
FIG. 1 is a perspective view of an erected article-transport container with four tri-layer corners in accordance with a first embodiment of the present disclosure showing that the article-transport container includes (on the lower left) a front end wall coupled to a left side closure (on the left side) including a horizontal left canopy and a right side closure (on the right side) including a horizontal right canopy and a rear end wall coupled to the left and right side closures.
Figure 2:
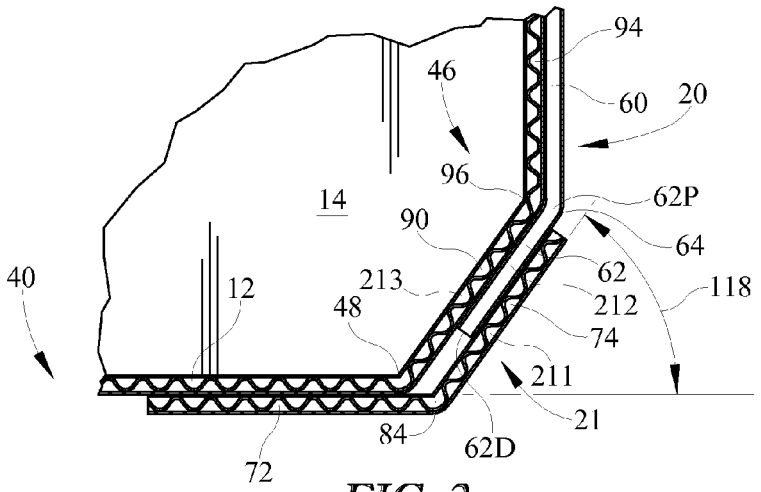
FIG. 2 is a sectional view taken along line 2-2 of FIGS. 1 and 9 showing that a first tri-layer corner included in the article-transport container includes an outer layer in which the corrugation is oriented vertically, a spaced-apart inner layer in which the corrugation is oriented vertically, and a medial layer positioned to lie between the inner and outer layers and having corrugation that is oriented horizontally.
Figure 10:
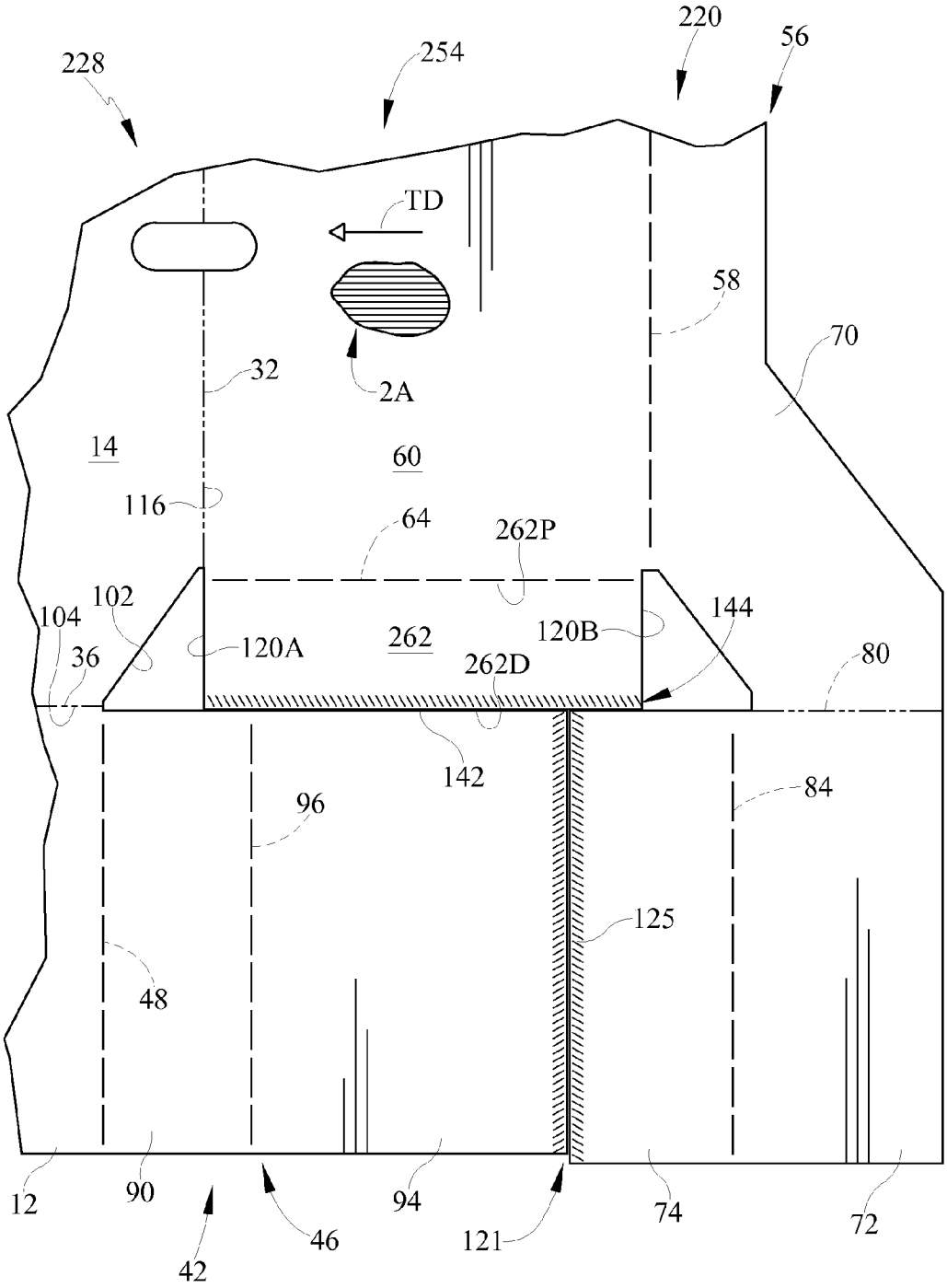
FIGS. 10-12 show how the blank of FIG. 3 can be varied to produce a container characterized by each tri-layer corner having a medial layer that extends fully between the right side wall and the front end wall when the container is formed.
Figure 11:
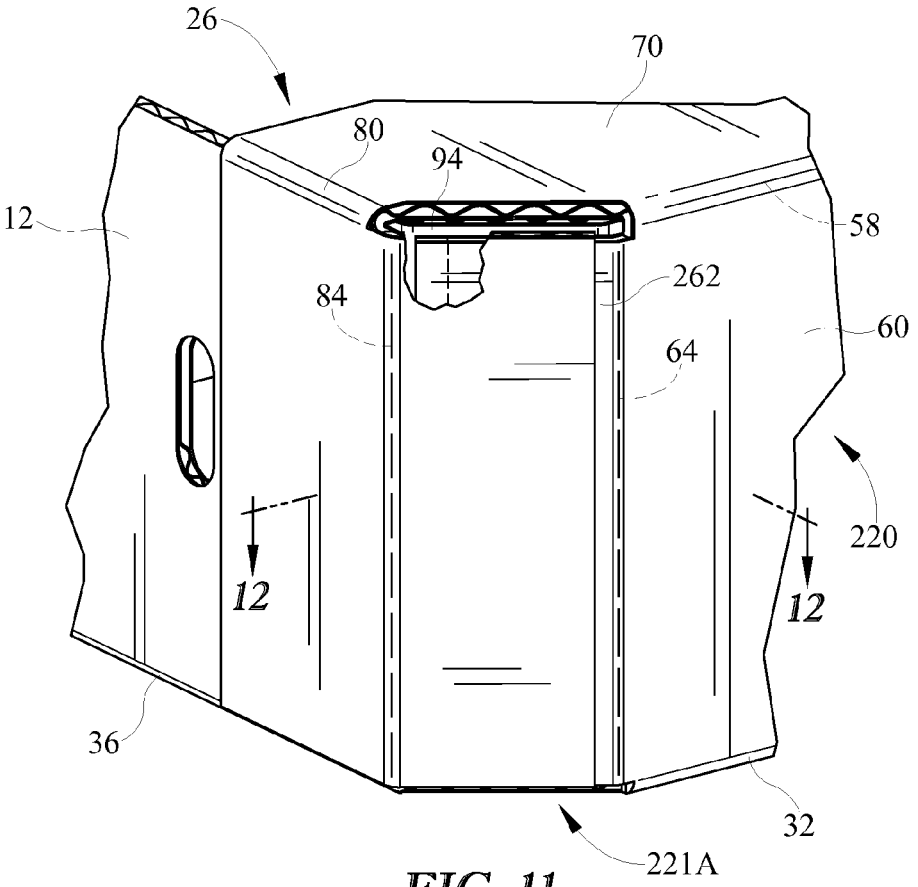
Figure 12:
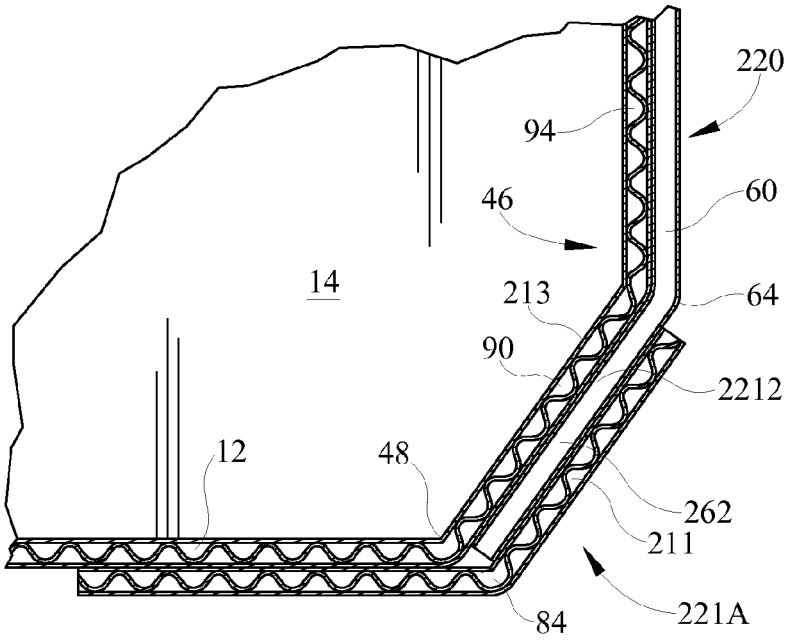

An erected article-transport container 10 in accordance with the present disclosure is shown in FIG. 1. Article-transport container 10 includes four tri-layer corners 21, 22, 23, 24 in accordance with a first embodiment of the present disclosure and first tri-layered corner 21 is shown in FIG. 2. Article-transport container 10 includes, in series starting in the front left, a front end wall 12 coupled to a floor 14 included in container 10, a left side closure 16 coupled to floor 14 and including a left canopy 70L overlying floor 14, a rear end wall 18 coupled to floor 14, and a right side closure 20 coupled to floor 14 and including a right canopy 70 overlying floor 14. Front end wall 12, left side closure 16, rear end wall 18, right side closure 20, floor 14, and tri-layer corners 21, 22, 23, 24 cooperate to define an interior region 26 therebetween that is adapted to receive articles (not shown) therein. Another embodiment of a tri-layer corner 221A is shown in FIGS. 10-12.

Tri-layer corners 21, 22, 23, 24 cooperate to provide means for increasing stack strength of container 10 while simplifying blank forming and minimizing scrap produced during blank forming. As an example, first tri-layer corner 21 includes an outer layer 211, a medial layer 212, and an inner layer 213 as shown in FIG. 2. Medial layer 212 is positioned to lie between outer layer 211 and inner layer 213 and is configured to provide means for interconnecting outer layer 211 and inner layer 213 to cause stack strength of container 10 to be improved while minimizing scrap produced during blank forming so that costs associated with producing container 10 are minimized.

Figure 3:
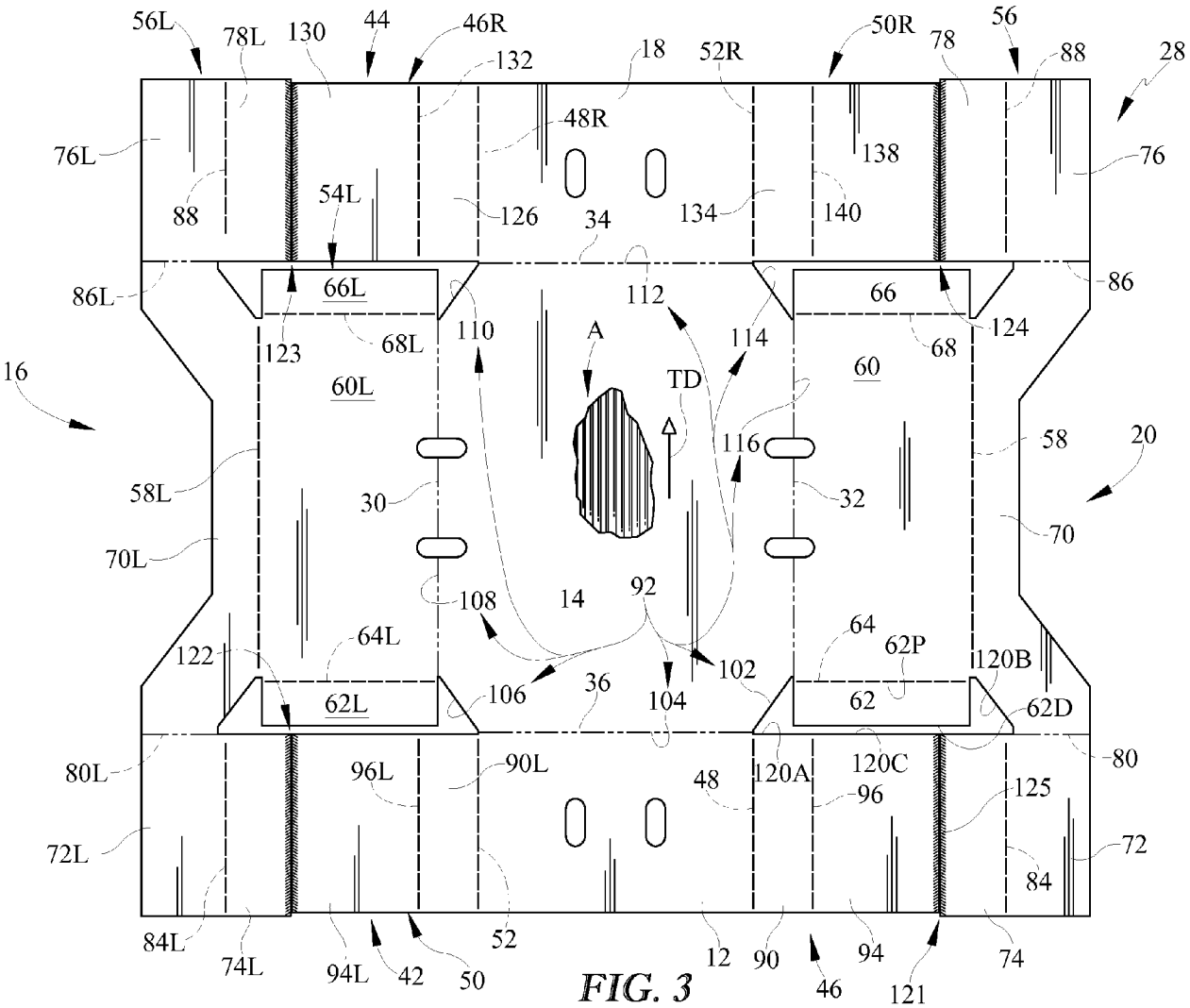
FIG. 3 is a plan view of a blank of corrugated material used to form the container of FIG. 1 and showing that the blank includes an octagon-shaped floor, a left side closure coupled to the floor (at the left of the page), a rear end strip (at the top of the page), a right side closure (at the right of the page) comprising, from left to right, a right inner strip including, from top to bottom, a second wall anchor flap, a right side wall coupled to the floor, and a first wall anchor flap that forms the medial layer of the first tri-layer corner and a right outer strip including, from top to bottom, a second auxiliary canopy anchor flap, a second primary canopy anchor flap, a right canopy coupled to the right side wall, a first primary canopy anchor flap, and a first auxiliary canopy anchor flap forming the outer layer of the first tri-layer corner, and a front end strip (at the bottom of the page) including, from left to right, a second front anchor flap, a front end wall coupled to the floor, and a first front anchor flap including a right corner bridge that forms the inner layer of the first tri-layer corner and a right corner tab.

Container 10 is made from a blank 28 after blank 28 is formed in a blank-forming process. As shown in FIG. 3, blank 28 includes floor 14, left side closure 16 appended to floor 14 along a left-side fold line 30, right side closure 20 appended to floor 14 along a right-side fold line 32, rear end wall 18 appended to floor 14 along a rear-end fold line 34, and front end wall 12 appended to floor 14 along a front-end fold line 36. Right side closure 20, left side closure 16, rear end wall 18, front end wall 12, and tri-layer corners 21, 22, 23, 24 cooperate to form a border coupled to floor 14 and arranged to cooperate with floor 14 to define interior region 26 of container 10.

Rear end wall 18 cooperates with left side closure 16 and right side closure 20 to establish a rear end 38 of container 10 as shown in FIG. 1. Front end wall 12 cooperates with left side closure 16 and right side closure 20 to establish a front end 40 of container 10 as shown in FIG. 1. It is within the scope of the present disclosure to make blank 28 from a variety of materials including corrugated paperboard, folding carton, and solid fiber and other materials such as plastic sheeting and corrugated plastic.

Figure 4:
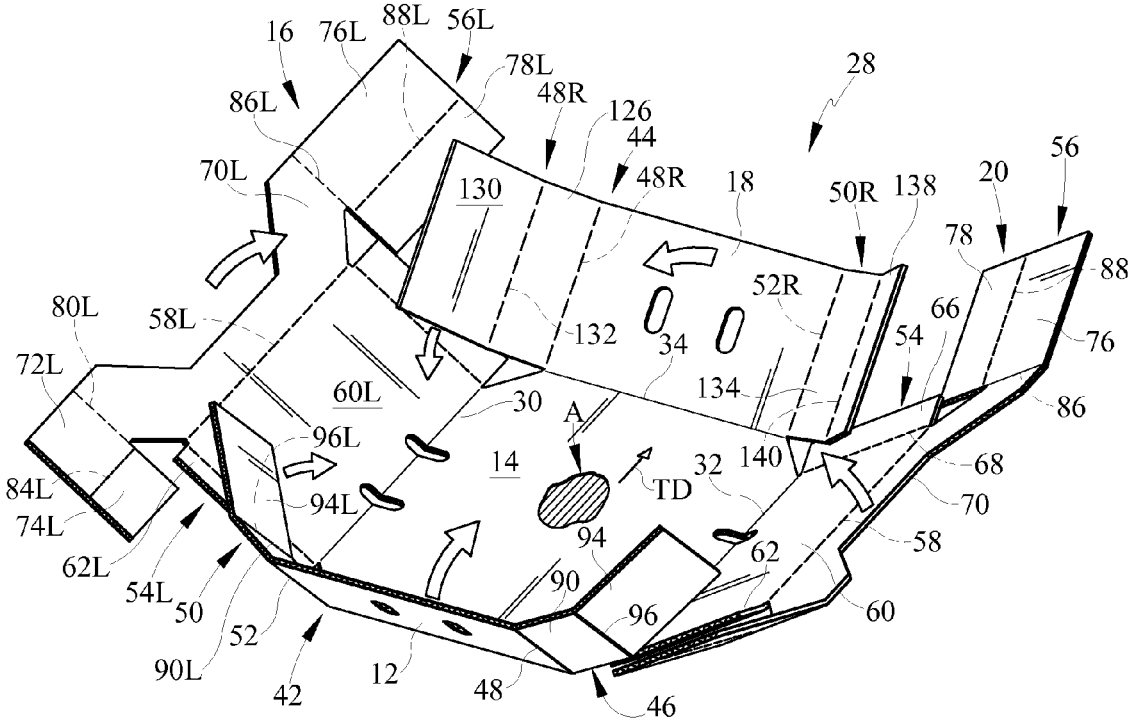
FIGS. 4-9 are a series of views showing a method of forming the article transport container of FIG. 1 using the blank of FIG. 3.

Article-transport container 10 is established as result of passing blank 28 through a container-forming process shown, for example, in FIGS. 4-9. As shown in FIG. 3, blank 28 includes floor 14, a front end strip 42 coupled to floor 14 along front-end fold line 36, left side closure 16 coupled to floor 14 along left-side fold line 30, a rear end strip 44 coupled to floor 14 along rear-end fold line 34, and right side closure 20 coupled to floor 14 along right-side fold line 32 as shown in FIG. 4.

Figure 6:
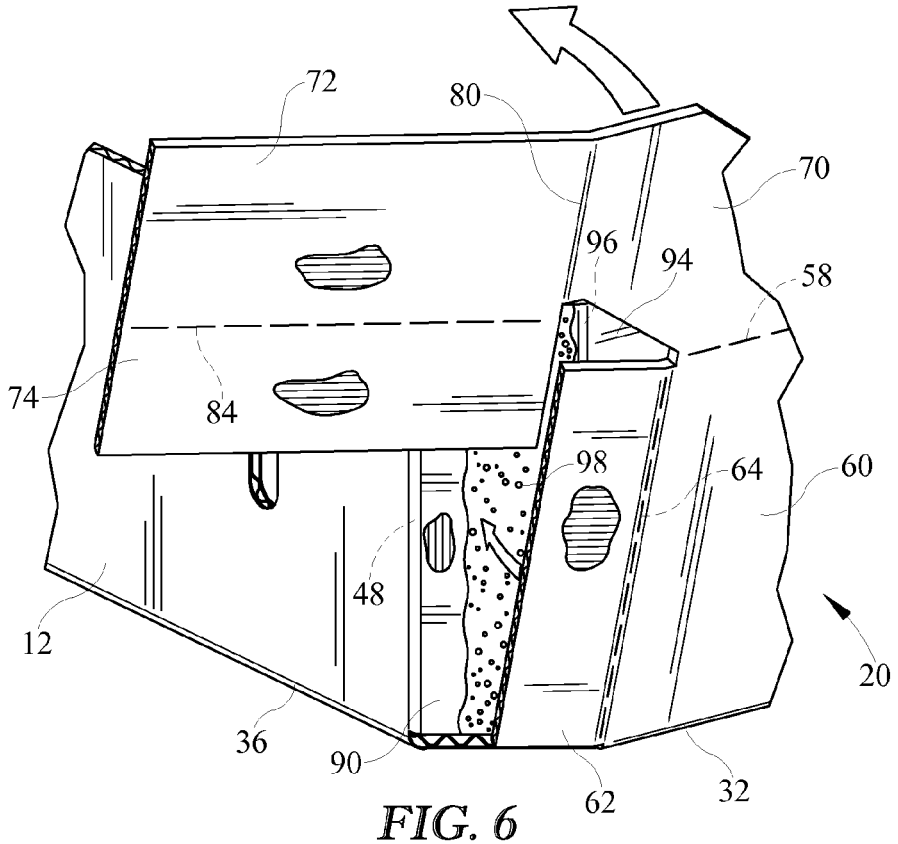

Front end strip 42 illustratively includes front end wall 12, a first front anchor flap 46 coupled to front end wall 12 about a first front anchor-flap fold line 48, and a second front anchor flap 50 coupled to front end wall 12 about a second front anchor-flap fold line 52 as shown in FIG. 3. First front anchor flap 46 is positioned to lie in spaced-apart relation to second front anchor flap 50 to locate front end wall 12 therebetween. As shown in FIGS. 2 and 6, a portion of first front anchor flap 46 is used to establish inner layer 213 of first tri-layer corner 21. Similarly, a portion of second front anchor flap 50 is used to establish inner layer 223 of second tri-layer corner 22.

First front anchor flap 46 includes a front right corner bridge 90 that is coupled to front end wall 12 about a first front anchor-flap fold line 48 and a front right anchor tab 94 that is coupled to front right corner bridge 90 about a first front anchor-tab fold line 96 as shown in FIG. 3. Inner layer 213 of first tri-layer corner 21 is established during an initial stage of container forming as suggested in FIGS. 4-9.

During the initial stage of container formation, front end strip 42 is folded about front-end fold line 36 toward floor 14. At the same time, front right corner bridge 90 is folded inwardly toward floor 14 about first front anchor-flap fold line 48 and front right anchor tab 94 is folded inwardly toward floor 14 about first front anchor-tab fold line 96. As a result, front end strip 42 is arranged to extend upwardly away from floor 14 and front right anchor tab 94 is arranged to extend along right-side fold line 32. Front right corner bridge 90 is arranged to extend between and interconnect front right anchor tab 94 and front end wall 12.

Right side closure 20 illustratively includes a right inner strip 54 coupled to floor 14 about right-side fold line 32 and a right outer anchor strip 56 coupled to right inner strip 54 about a right anchor-strip fold line 58 as shown in FIG. 3. Right inner strip 54 includes, for example, a right side wall 60, a first right wall anchor flap 62 coupled to right side wall 60 about a first right wall flap fold line 64, and a second right wall anchor flap 66 coupled to right side wall 60 about a second right wall flap fold line 68 as shown in FIG. 3. First right wall anchor flap 62 is used to establish medial layer 212 of first tri-layer corner 21. Medial layer 212 of first tri-layer corner 21 is established during a subsequent stage of container forming as suggested in FIGS. 4-9.

Figure 5:
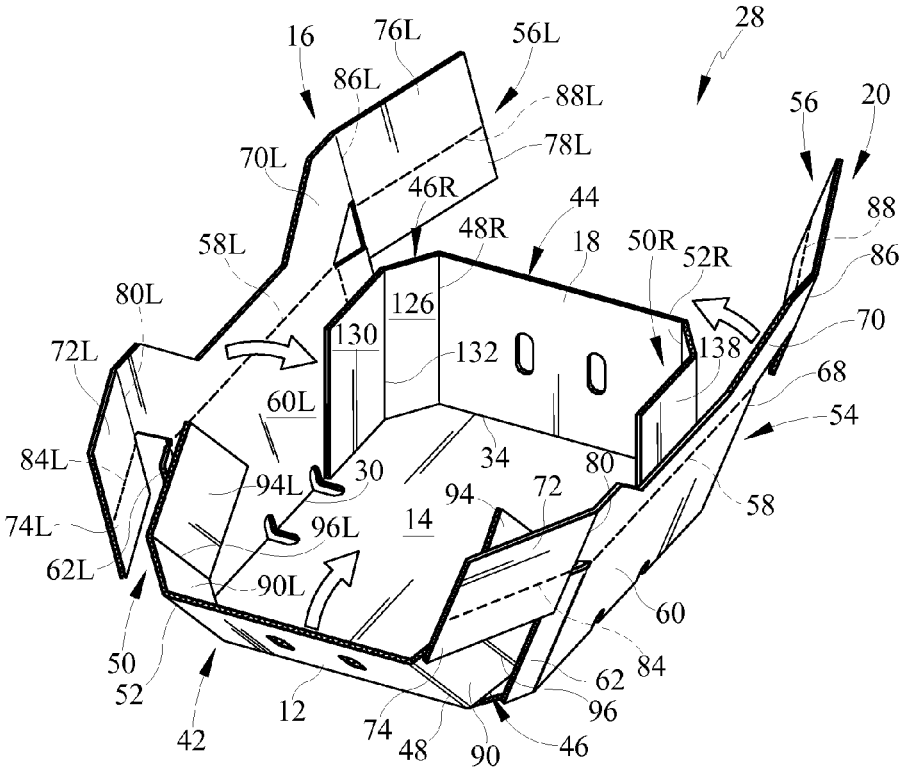

During the subsequent stage of container forming, right side closure 20 is folded about right-side fold line 32 toward floor 14 so that right side wall 60 and first and second right wall anchor flap 62, 66 extend upwardly away from floor 14 as shown in FIG. 5. At the same time, first and second right wall anchor flaps 62, 66 are folded inwardly toward floor 14 about associated right wall flap fold lines 64, 68. As an example, first right wall anchor flap 62 is arranged to extend away from right side wall 60 toward front end wall 12 and is coupled to front right corner bridge 90 and form medial layer 212 as shown in FIGS. 2 and 7.

Right outer anchor strip 56 includes a right canopy 70, a first right primary canopy anchor flap 72, a first right auxiliary canopy anchor flap 74, a second right primary canopy anchor flap 76, and a second right auxiliary canopy anchor flap 78 as shown in FIG. 3. Right canopy 70 is coupled to right side wall 60 about right anchor-strip fold line 58. First right primary canopy anchor flap 72 is coupled to right canopy 70 by a first right primary flap fold line 80. First right auxiliary canopy anchor flap 74 is coupled to first right primary canopy anchor flap 72 by a first right auxiliary flap fold line 84 as shown in FIG. 3. Second right primary canopy anchor flap 76 is coupled to right canopy 70 by a second right primary flap fold line 86. Second right auxiliary canopy anchor flap 78 is coupled to second right primary canopy anchor flap 76 by a first right auxiliary flap fold line 88 as shown in FIG. 3. Outer layer 211 of first tri-layer corner 21 is established during a last stage of container forming as suggested in FIGS. 8 and 9.

During the last stage of container forming, right outer anchor strip 56 is folded about right anchor-strip fold line toward floor 14 so that right canopy 70 is arranged to lie in spaced-apart parallel relation above floor 14 as shown in FIG. 2. At the same time, first right primary and auxiliary canopy anchor flaps 72, 74 are folded downwardly about first right primary flap fold line 80 so that first right primary canopy anchor flap 72 extends downwardly and mates with front end wall 12 as suggested in FIG. 7 and shown in FIG. 8. Finally, first tri-layer corner 21 is established as a result of folding first right auxiliary canopy anchor flap 74 about first right auxiliary flap fold line 84 toward first right wall anchor flap 62 as suggested in FIG. 8 and shown in FIG. 9.

Figure 7:
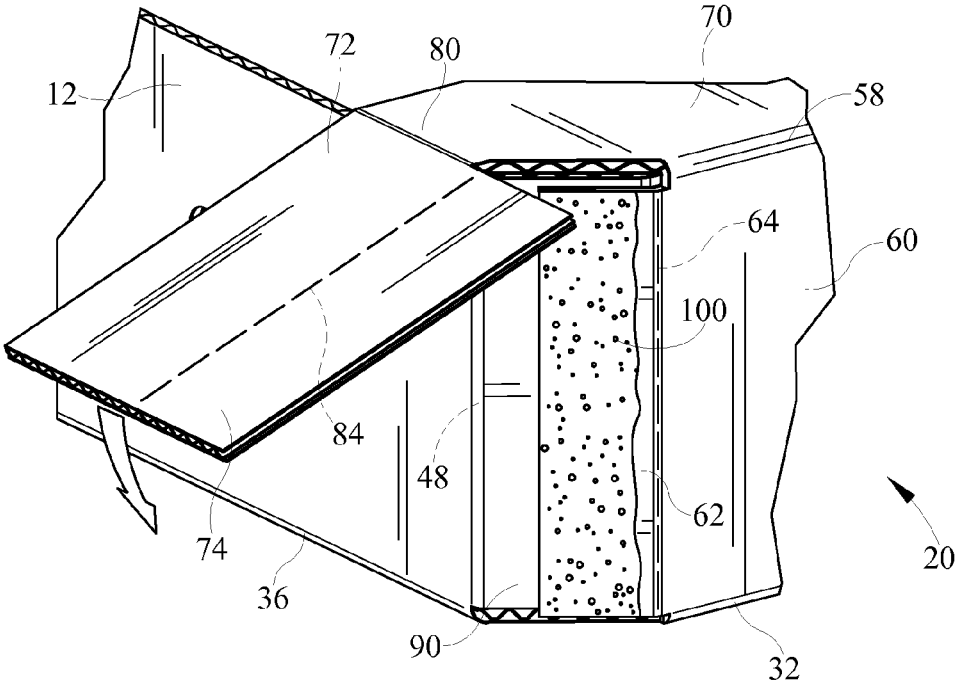
Figure 8:
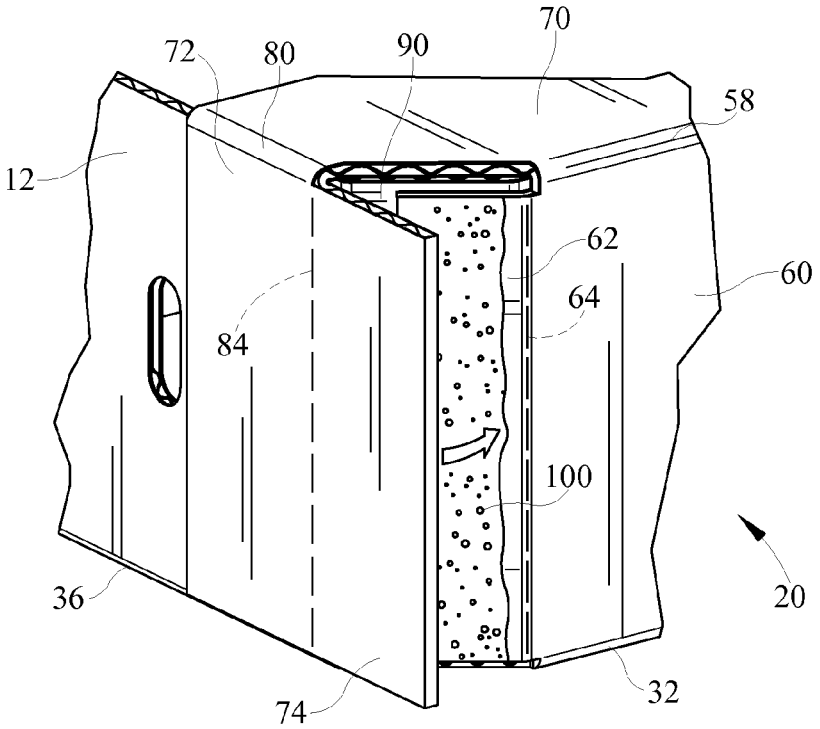
Figure 9:
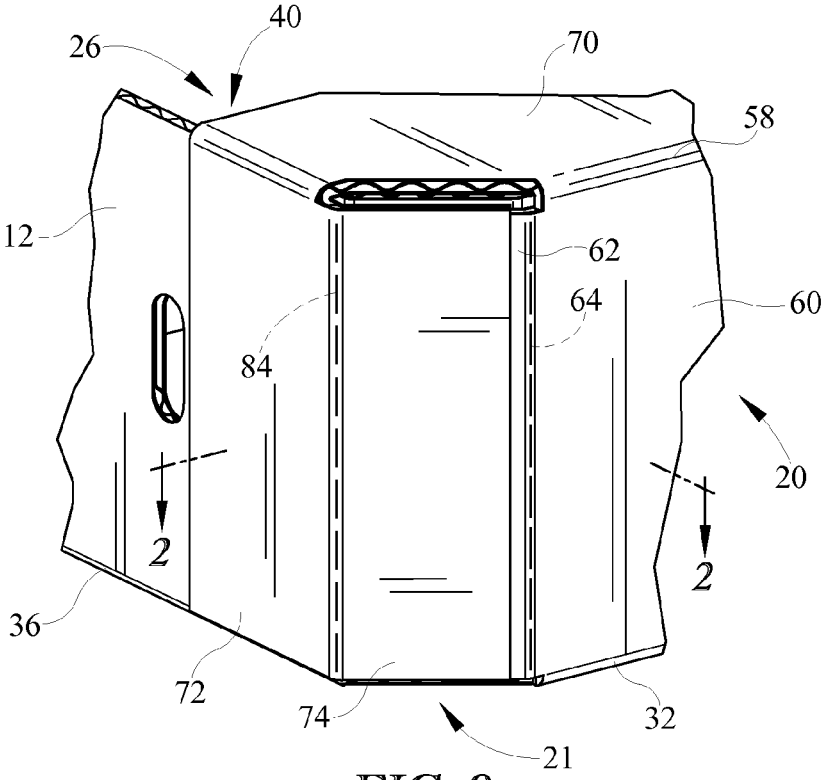

First tri-layer corner 21 is established as a result of coupling first right wall anchor flap 62 to front right corner bridge 90 and by coupling first right auxiliary canopy anchor flap 74 to first right wall anchor flap 62 as shown in FIGS. 6-9. As an example, first right wall anchor flap 62 is coupled to front right corner bridge 90 by adhesive 98 as shown in FIG. 6. First right auxiliary canopy anchor flap 74 is coupled to first right wall anchor flap 62 by adhesive 100 as shown in FIGS. 7 and 8. While adhesive 98, 100 is shown as an example, any other suitable alternative may be used.

In an illustrative embodiment, the corrugation of blank 28 is positioned to run in a transverse direction TD as shown in insert A in FIGS. 1, 3, and 4. As a result, inner and outer layers 211, 213 of tri-layer corners 21, 22, 23, 24 have corrugation which runs vertically as shown in FIG. 6 after container 10 has been formed. Medial layer 212 has corrugation which runs horizontally as shown in FIG. 6 after container 10 has been formed. In one illustrative example, it was found surprisingly that the medial layers of tri-layer corners 21, 22, 23, 24 increases stacking strength of container 10 as compared to those containers lacking medial layer 212. Stacking strength may be measured using standard industry test methods. As an example, stacking strength was evaluated using the TSL-8.2-WI-005 test method and procedure reference T804 of the Technical Association of the Pulp and Paper Industry (TAPPI).

As illustrated in FIG. 3, floor 14 has an octagon shape that includes in series, a first mitered edge 102, a front end edge 104, a second mitered edge 106, a left edge 108, a third mitered edge 110, a rear end edge 112, a fourth mitered edge 114, and a right edge 116. As an illustrative example, left and right edges 108, 116 have lengths greater than lengths of front and rear end edges 104, 112. Front and rear end edges 104, 112 have lengths greater than first, second, third, and fourth mitered edges 102, 106, 110, 114. Edges 102, 104, 106, 108, 110, 112, 114 cooperate to define a floor perimeter 92 as shown in FIG. 3.

First tri-layer corner 21 is arranged to extend between front end wall 12 and right side wall 60 and lie at an angle 118 relative to front end wall 12 as shown in FIG. 2. Angle 118 is defined to be between first mitered edge 102 of floor 14 and front end edge 104 of floor 14. As shown in FIG. 2, angle 118 is illustratively an acute angle. Inner layer 213 of tri-layer corner 21 is positioned to lie inside floor perimeter 92 and is arranged to extend between front end edge 104 and right edge 116 and between floor 14 and right canopy 70. Medial layer 212 is positioned to lie outside floor perimeter 92 is and is arranged to extend along first mitered edge 102 so that medial layer 212 lies at angle 118. Outer layer 211 is positioned to lie outside floor perimeter 92 and is arranged to lie in spaced-apart relation to first mitered edge 102 to cause medial layer 212 to lie there between.

Blank 28 is formed during an illustrative blank forming process, for example in a manufacturing facility. During the blank forming process, a corrugated sheet is processed to establish blank 28 and scrap which separated from blank 28. During blank forming, first right wall anchor flap 62 is formed to have a proximal end 62P and a distal end 62D which is spaced-apart from proximal end 62P. First right wall anchor flap 62 is appended to right side wall 60 along first right wall flap fold line 64 by proximal end 62P. As shown in FIG. 3, first right wall anchor flap 62 extends away from first right wall flap fold line 64 toward first front anchor flap 46 and first right auxiliary canopy anchor flap 74 such that distal end 62D is spaced apart from first front anchor flap 46 and first right auxiliary canopy anchor flap 74.

During the blank forming process which may be performed in a manufacturing facility, scrap is separated from blank 28 which causes two triangle-shaped apertures 120A, 120B and an interconnecting rectangle-shaped aperture 120C to be formed therein. As a result of the scrap piece being monolithic, it simplifies removal and separation from blank 28. Another result of distal end 62D being spaced apart from first front anchor flap 46 and first right auxiliary canopy anchor flap 74 is that rectangle-shaped aperture 120C is formed by removing scrap. Container forming is simplified as a result of distal end 62D of first right wall anchor flap 62 being spaced-apart from first front anchor flap 46 and first right auxiliary canopy anchor flap 74 is that friction between distal end 62D of and first front anchor flap 46 and first right auxiliary canopy anchor flap 74 is eliminated. Because friction has been eliminated, the likelihood of forming improperly formed containers is minimized.

Also during blank forming, a first crush area 121 is formed in blank 28. First crush area 121 is configured to provide means for minimizing friction developed between front right anchor tab 94 and first right auxiliary canopy anchor flap 74 during container forming as front right anchor tab 94 of front end strip 42 is folded upwardly about front-end fold line 36. Second, third, and fourth crush areas 122, 123, 124 are also formed.

First, second, third, and fourth crush areas 122, 123, 124 are substantially similar to first crush area 121, and thus, only first crush area 121 will be discussed in detail. First crush area 121 is established along a cut line 125 formed between front right anchor tab 94 and first right auxiliary canopy anchor flap 74 as shown in FIG. 3. A rate of container forming may be increased as a result of minimizing friction which decreases the likelihood of improperly forming containers. These improperly formed containers are also called as cripples. Blank 28 and resulting container 10 minimize waste because the number of improperly formed containers is minimized.

Second tri-layer corner 22 is formed during container forming by folding front end strip 42 and left side closure 16 so that second tri-layer corner 22 is established as a result as suggested in FIGS. 4 and 5. A portion of second front anchor flap 50 establishes an inner layer 223 of second tri-layer corner 22.

Second front anchor flap 50 includes a front left corner bridge 90L that is coupled to front end wall 12 about a second front anchor-flap fold line 52 and a front left anchor tab 94L that is coupled to front left corner bridge 90L about a second front anchor-tab fold line 96L as shown in FIG. 3 Inner layer 223 of second tri-layer corner 22 is established during an initial stage of container forming as suggested in FIGS. 4 and 5.

During the initial stage of container formation, front end strip 42 is folded about front-end fold line 36 toward floor 14. At the same time, front left corner bridge 90L is folded inwardly toward floor 14 about second front anchor-flap fold line 52 and front right anchor tab 94L is folded inwardly toward floor 14 about second front anchor-tab fold line 96L. As a result, front end strip 42 is arranged to extend upwardly away from floor 14 and front left anchor tab 94L is arranged to extend along left-side fold line 30. Front left corner bridge 90L is arranged to extend between and interconnect front left anchor tab 94L and front end wall 12.

Left side closure 16 illustratively includes a left inner strip 54L coupled to floor 14 about left-side fold line 30 and a left outer anchor strip 56L coupled to left inner strip 54L about a left anchor-strip fold line 58L as shown in FIG. 3. Left inner strip 54L includes, for example, a left side wall 60L, a first left wall anchor flap 62L coupled to left side wall 60L about a first left wall flap fold line 64L, and a second left wall anchor flap 66L coupled to left side wall 60L about a second left wall flap fold line 68L as shown in FIG. 3. First left wall anchor flap 62L establishes medial layer 222 of second tri-layer corner 22. Medial layer 222 of second tri-layer corner 22 is established during the subsequent stage of container forming.

During the subsequent stage of container forming, left side closure 16 is folded about left-side fold line 30 toward floor 14 so that left side wall 60L and first and second left wall anchor flaps 62L, 66L extend upwardly away from floor 14 as shown in FIG. 5. At the same time, first and second left wall anchor flaps 62L, 66L are folded inwardly toward floor 14 about associated left wall flap fold lines 64L, 68L. As an example, first left wall anchor flap 62L is arranged to extend away from left side wall 60L toward front end wall 12 and is coupled to front left corner bridge 90L and form medial layer 222.

Left outer anchor strip 56L includes a left canopy 70L, a first left primary canopy anchor flap 72L, a first left auxiliary canopy anchor flap 74L, a second left primary canopy anchor flap 76L, and a second left auxiliary canopy anchor flap 78L as shown in FIG. 3. Left canopy 70L is coupled to left side wall 60L about left anchor-strip fold line 58L. First left primary canopy anchor flap 72L is coupled to left canopy 70L by a first left primary flap fold line 80L. First left auxiliary canopy anchor flap 74L is coupled to first left primary canopy anchor flap 72L by a first left auxiliary flap fold line 84L as shown in FIG. 3. Second left primary canopy anchor flap 76L is coupled to left canopy 70L by a second left primary flap fold line 86L. Second left auxiliary canopy anchor flap 78L is coupled to second left primary canopy anchor flap 76L by a first left auxiliary flap fold line 88L as shown in FIG. 3. Outer layer 221 of second tri-layer corner 22 is established during the last stage of container forming.

During the last stage of container forming, left outer anchor strip 56L is folded about left anchor-strip fold line 58L toward floor 14 so that left canopy 70L is arranged to lie in spaced-apart parallel relation to floor 14. At the same time, first left primary and auxiliary canopy anchor flaps 72L, 74L are folded downwardly about first left primary flap fold line 80L so that first left primary canopy anchor flap 72L extends downwardly and mates with front end wall 12. Finally, second tri-layer corner 22 is established as a result of folding first left auxiliary canopy anchor flap 74L about first left auxiliary flap fold line 84L toward first left wall anchor flap 62L.

Second tri-layer corner 22 is established as a result of coupling first left wall anchor flap 62L to front left corner bridge 90L and by coupling first left auxiliary canopy anchor flap 74L to first left wall anchor flap 62L. As an example, first left wall anchor flap 62L is coupled to front left corner bridge 90L by adhesive and first left auxiliary canopy anchor flap 74L is coupled to front left corner bridge 90L by adhesive.

Third tri-layer corner 23 is formed during container forming by folding front end strip 42 and left side closure 16 so that third tri-layer corner 23 is established as a result as suggested in FIGS. 4 and 5. A portion of rear end strip 44 establishes an inner layer 233 of third tri-layer corner 23.

Rear end strip 44 illustratively includes rear end wall 18, a first rear anchor flap 46R coupled to rear end wall 18 about a first rear anchor-flap fold line 48R, and a second rear anchor flap 50R coupled to rear end wall 18 about a second rear anchor-flap fold line 52R as shown in FIG. 3. First rear anchor flap 46R is positioned to lie in spaced-apart relation to second rear anchor flap 50R to locate rear end wall 18 therebetween.

A portion of first rear anchor flap 46R is used to establish inner layer 233 of third tri-layer corner 23. Similarly, a portion of second rear anchor flap 50R is used to establish inner layer 243 of fourth tri-layer corner 24.

First rear anchor flap 46R includes a rear left corner bridge 126 that is coupled to rear end wall 18 about a first rear anchor-flap fold line 48R and a rear left anchor tab 130 that is coupled to rear left corner bridge 126 about a first rear anchor-tab fold line 132 as shown in FIG. 3. Inner layer 233 of third tri-layer corner 23 is established during the initial stage of container forming as suggested in FIGS. 4 and 5.

During the initial stage of container formation, rear end strip 44 is folded about rear-end fold line 34 toward floor 14. At the same time, rear left corner bridge 126 is folded inwardly toward floor 14 about first rear anchor-flap fold line 48R and rear left anchor tab 130 is folded inwardly toward floor 14 about first rear anchor-tab fold line 132. As a result, rear end strip 44 is arranged to extend upwardly away from floor 14 and rear left anchor tab 130 is arranged to extend along left-side fold line 30. Rear left corner bridge 126 is arranged to extend between and interconnect rear left anchor tab 130 and rear end wall 18.

During the subsequent stage of container forming, left side closure 16 is folded about left-side fold line 30 toward floor 14 so that left side wall 60L and first and second left wall anchor flap 62L, 66L extend upwardly away from floor 14 as shown in FIG. 5. At the same time, first and second left wall anchor flaps 62L, 66L are folded inwardly toward floor 14 about associated left wall flap fold lines 64L, 68L. As an example, second left wall anchor flap 66L is arranged to extend away from left side wall 60L toward rear end wall 18 and is coupled to rear left corner bridge 126 to form medial layer 232.

During the last stage of container forming, left outer anchor strip 56L is folded about left anchor-strip fold line 58L toward floor 14 so that left canopy 70L is arranged to lie in spaced-apart parallel relation to floor 14 as shown in FIG. 2. At the same time, second left primary and auxiliary canopy anchor flaps 76L, 78L are folded downwardly about second left primary flap fold line 86L so that second left primary canopy anchor flap 76L extends downwardly and mates with rear end wall 18. Finally, third tri-layer corner 23 is established as a result of folding second left auxiliary canopy anchor flap 78L about second left auxiliary flap fold line 88L toward second left wall anchor flap 62L.

Third tri-layer corner 23 is established as a result of coupling second left wall anchor flap 66L to rear left corner bridge 126 and by coupling second left auxiliary canopy anchor flap 78L to rear left corner bridge 126. As an example, second left wall anchor flap 66L is coupled to rear left corner bridge 126 by adhesive and second left auxiliary canopy anchor flap 78L is coupled to rear left corner bridge 126 by adhesive.

Fourth tri-layer corner 24 is formed during container forming by folding rear end strip 44 and right side closure 20 so that fourth tri-layer corner 24 is established as a result as suggested in FIGS. 4 and 5. A portion of second rear anchor flap 50R establishes inner layer 243 of fourth tri-layer corner 24.

Second rear anchor flap 50R includes a rear right corner bridge 134 that is coupled to rear end wall 18 about a second rear anchor-flap fold line 52R and a rear right anchor tab 138 that is coupled to rear right corner bridge 134 about a second rear anchor-tab fold line 140 as shown in FIG. 3. Inner layer 243 of fourth tri-layer corner 24 is established during the initial stage of container forming as suggested in FIGS. 4 and 5.

During the initial stage of container forming, rear end strip 44 is folded about rear-end fold line 34 toward floor 14. At the same time, rear right corner bridge 134 is folded inwardly toward floor 14 about second rear anchor-flap fold line 52R and rear right anchor tab 138 is folded inwardly toward floor 14 about second rear anchor-tab fold line 140. As a result, rear end strip 44 is arranged to extend upwardly away from floor 14 and rear right anchor tab 138 is arranged to extend along right-side fold line 32. Rear right corner bridge 134 is arranged to extend between and interconnect rear right anchor tab 138 and rear end wall 18.

During the subsequent stage of container forming, right side closure 20 is folded about right-side fold line 32 toward floor 14 so that right side wall 60 and first and second right wall anchor flap 62, 66 extend upwardly away from floor 14 as shown in FIG. 5. At the same time, first and second right wall anchor flaps 62, 66 are folded inwardly toward floor 14 about associated right wall flap fold lines 64, 68. As an example, second right wall anchor flap 68 is arranged to extend away from right side wall 60 toward rear end wall 18 and is coupled to rear right corner bridge 134 and form medial layer 242.

During the last stage of container forming, right outer anchor strip 56 is folded about right anchor-strip fold line 58 toward floor 14 so that right canopy 70 is arranged to lie in spaced-apart parallel relation to floor 14 as shown in FIG. 2. At the same time, second right primary and auxiliary canopy anchor flaps 76, 78 are folded downwardly about second right primary flap fold line 86 so that second right primary canopy anchor flap 76 extends downwardly and mates with rear end wall 18. Finally, fourth tri-layer corner 24 is established as a result of folding second right auxiliary canopy anchor flap 78 about second right auxiliary flap fold line 88 toward second right wall anchor flap 66.

Fourth tri-layer corner 24 is established as a result of coupling second right wall anchor flap 66 to rear right corner bridge 134 and by coupling second right auxiliary canopy anchor flap 78 to rear right corner bridge 134. As an example, second right wall anchor flap 66 is coupled to rear right corner bridge 134 by adhesive and second right auxiliary canopy anchor flap 78 is coupled to rear right corner bridge 134 by adhesive.

A portion of a blank 218 of corrugated material in accordance with a second embodiment of the present disclosure is shown in FIG. 10 and can be assembled as suggested in FIG. 10 to produce a first tri-layer corner 221A of a container 210 as shown in FIG. 12. In most respects, blank 218 is similar to blank 28 of FIG. 3.

Blank 218 includes floor 14, a right side closure 220 appended to floor 14 along right-side fold line 32, and a front end strip 42 appended to floor 14 along front-end fold line 36 as shown in FIG. 10. Right side closure 220 and front end strip 42 are configured to be folded in a manner similar to that shown in FIGS. 4-9 to produce first tri-layer corner 221A.

As discussed previously, first tri-layer corner 221A includes outer layer 211, a medial layer 2212, and inner layer 213 as shown in FIGS. 11 and 12. Inner layer 213 is provided by front right corner bridge 90 of front end strip 42 and is established during initial folding of blank 218. Medial layer 2212 is provided by a first right wall anchor flap 262 included in right side closure 220 and is established during the subsequent folding of blank 218. Outer layer 211 is provided by first right auxiliary canopy anchor flap 74 and is established during the final folding of blank 218.

Right side closure 220 illustratively includes a right inner strip 254 coupled to floor 14 about right-side fold line 32 and right outer anchor strip 56 coupled to right inner strip 254 about right anchor-strip fold line 58 as shown in FIG. 10. Right inner strip 254 includes, for example, right side wall 60, a first right wall anchor flap 262 coupled to right side wall 60 about first right wall flap fold line 64, and a second right wall anchor flap (not shown) coupled to right side wall 60 about second right wall flap fold line (not shown). First right wall anchor flap 262 establishes medial layer 2212 of first tri-layer corner 221A. Medial layer 2212 of first tri-layer corner 221A is established during the subsequent stage of container 210 in a manner similar to that of container 10 suggested in FIGS. 4-9.

Blank 218 is formed during an illustrative blank forming process in which a corrugated sheet is processed to establish blank 218 and scrap which is separated from blank 218. During blank forming, first right wall anchor flap 262 is formed to have a proximal end 262P and a distal end 262D which is spaced-apart from proximal end 262P. First right wall anchor flap 262 is appended to right side wall 60 along first right wall flap fold line 64 by proximal end 262P. As shown in FIG. 10, first right wall anchor flap 262 extends away from first right wall flap fold line 64 toward first front anchor flap 46 and first right auxiliary canopy anchor flap 74 such that distal end 262D abuts first front anchor flap 46 and first right auxiliary canopy anchor flap 74. Distal end 262D is separated from first front anchor flap 46 and first right auxiliary canopy anchor flap 74 by a cut line 142 as shown in FIG. 10.

During blank forming, scrap is separated from blank 218 which causes two triangle-shaped apertures 120A, 120B to be formed therein. In comparison to blank 28, blank 218 lacks rectangle-shaped aperture 120C thus causing triangle-shaped apertures 120A, 120B to be separate from one another. As a result of distal end 262D of first right wall anchor flap 262 abutting first front anchor flap 46 and first right auxiliary canopy anchor flap 74, friction is developed during container forming as front end strip 42 is folded upwardly about front-end fold line 36. A first right-wall anchor-flap crush area 144 which is established during blank forming to provide means for minimizing friction developed between first right wall anchor flap 262 and first front anchor flap 46 and first right auxiliary canopy anchor flap 74 during container forming so that the likelihood of creating improperly formed containers is minimized.

In an illustrative embodiment, the corrugation of blank 218 is positioned to run in a transverse direction TD as shown in insert 2A in FIG. 10. As a result, inner and outer layers 211, 213 of tri-layer corner 221A has corrugation which runs vertically as shown in FIG. 12 after container 210 has been formed. Medial layer 2212 has corrugation which runs horizontally as shown in FIG. 10 after container 10 has been formed. In one illustrative example, it was found surprisingly that the medial layer 2212 of tri-layer corner 221A increases stacking strength of container 210 about 7%. Stacking strength may be measured using standard industry test methods. As an example, stacking strength was evaluated using the TSL-8.2-WI-005 test method and procedure reference T804 of the Technical Association of the Pulp and Paper Industry (TAPPI).

In another embodiment, the right canopy and the left canopy may be configured so as to establish a lid after the container has been formed. In an example, the right canopy has a width about equal to one half a width of the floor and the left canopy has a width about equal to one half the width of the floor. After the container has been erected, the right canopy is folded inwardly toward the floor about the right anchor-strip fold line so that the right canopy lies above the floor and extends away from the right side wall toward the left sidewall. The left canopy is also folded inwardly toward the floor about the left anchor-strip fold line so that the left canopy lies above the floor and extends away from the left side wall toward the right side wall. As a result, the interior region is defined by the floor, the right side closure, the left side closure, the front end wall, the rear end wall, the four tri-layer corners, and the lid established upon completion of forming the container.

In another embodiment, a container further includes a front canopy and a rear canopy. The front canopy is coupled to the front end wall about a front-canopy fold line. The rear canopy is coupled to the rear end wall about a rear-canopy fold line. After forming of the container, the front canopy lies in a plane positioned to lie between the right canopy and the floor. The rear canopy lies in a plane that is positioned to lie between the left canopy and the floor. The rear canopy, front canopy, left canopy, and right canopy cooperate to establish a framed top of the container.

What is claimed is:

1. An article-transport container comprising:

a floor (14) having a respective left-side and right-side closures (16) and (20) foldably joined thereto, a front end wall (12) foldably joined to the floor and to the respective left-side and right-side closures, a rear end wall (18) foldably joined to the floor and to the respective left-side and right-side closures, and at least one tri-layers corner cooperate with the respective left-side and right-side closures to define an interior region adapted to receive articles therein wherein the at least one tri-layer corner includes respective outer and inner layers (211) and (213) and a medial layer (212) being sandwiched between the respective outer and inner layers to enhance stacking strength of the container while minimizing scraps produced during construction of the container and wherein the at least one tri-layer corner includes four tri-layer corners defined by a first tri-layer corner, a second tri-layer corner, a third tri-layer corner, and a fourth tri-layer corner, the first tri-layer corner is arranged to extend between the front end wall and a right side wall and lie at an acute angle relative to the front end wall wherein the acute angle is defined to be between a first mitered edge of the floor and a front end edge of the floor and wherein the inner layer (211) being coupled to the front end wall (12), the outer layer (211) being formed from a second portion of the right-side closure (20), and the medial layer (212) being formed from a first portion of the right-side closure (20) such that a first right wall anchor flap (62) that forms the medial layer, is arranged to extend away from a right side wall (60) toward the front end wall (12) and is coupled to a right corner bridge (90) that forms the inner layer and wherein the medial layer includes corrugation that is arranged to extend horizontally parallel to the floor of the container.

2. The container of claim 1 wherein the respective right side and left side closures includes a corresponding right canopy and a corresponding left canopy wherein each of which is overlying the floor.

3. The container of claim 1 wherein the inner layer is positioned to lie inside of the floor perimeter and is arranged to extend between a front end edge and a right edge and between the floor and the right canopy.

4. The container of claim 1 wherein the medial layer is positioned to lie outside the floor perimeter and is arranged to extend along the first mitered edge of the floor so that medial layer lies at an acute angle.

5. The container of claim 1 wherein the outer layer is positioned to lie outside of the floor perimeter and is arranged to lie in spaced-apart relation to the first mitered edge of the floor to cause the medial layer to position therebetween.

6. The container of claim 1 wherein the first tri-layer corner is formed by coupling the first right wall anchor flap to the front right corner bridge and by coupling a first right auxiliary canopy anchor flap to the first right wall anchor flap.

7. The container of claim 1 wherein the second tri-layer corner is formed by coupling a first left wall anchor flap to a front left corner bridge and by coupling a first left auxiliary canopy anchor flap to the first left wall anchor flap.

8. The container of claim 1 wherein the third tri-layer corner is formed by coupling a second left wall anchor flap to a rear left corner bridge and by coupling a second left auxiliary canopy anchor flap to the rear left corner bridge.

9. The container of claim 1 wherein fourth tri-layer corner is formed by coupling a second right wall anchor flap to a rear right corner bridge and by coupling a second right auxiliary canopy anchor flap to the rear right corner bridge.

10. An article-transport container comprising:

a floor (14) having a respective left-side and right-side closures (16) and (20) foldably joined thereto, a front end wall (12) foldably joined to the floor and to the respective left-side and right-side closures, a rear end wall (18) foldably joined to the floor and to the respective left-side and right-side closures, and four tri-layer corners defined by a first tri-layer corner (21), a second tri-layer corner (22), a third tri-layer corner (23), and a fourth tri-layer corner (24) cooperate with the respective left-side and right-side closures to define an interior region adapted to receive articles therein and wherein each of the first, second, third, and fourth tri- layer corners includes respective outer and inner layers and a medial layer being sandwiched between the respective outer and inner layers to enhance stacking strength of the container while minimizing scarps produced during construction of the container and the medial layer includes corrugation that is arranged to extend horizontally parallel to the floor of the container and wherein the first tri-layer corner (21) is formed by coupling a first right wall anchor flap (62) to a front right corner bridge (90) and by coupling a first right auxiliary canopy anchor flap (74) to the first right wall anchor flap (62) and wherein the inner layer is provided by the front right corner bridge of a front end strip during initial folding, the medial layer is provided by the first right wall anchor flap included in the right side closure during subsequent folding and the outer layer is provided by the first right auxiliary canopy anchor flap and is established during the final folding.

11. A blank (218) for making an article-transport container comprising:

a floor (14), a right side closure (220) being appended to the floor (14) along right-side fold line (32), and a front end strip (42) being appended to the floor (14) along front-end fold line (36), the right side closure (220) and the front end strip (42) are configured to be folded to produce a first tri-layer corner (221A), the first tri-layer corner (221A) includes an outer layer (211), a medial layer (2212), and an inner layer (213), the inner layer (213) being provided by a front right corner bridge (90) of the front end strip (42) and is established during initial folding of blank (218), medial layer (2212) being provided by a first right wall anchor flap (262) included in the right side closure (220) and is established during the subsequent folding of blank (218) and wherein the medial layer includes corrugation that is arranged to extend horizontally parallel to the floor of the container the and the outer layer (211) being provided by a first right auxiliary canopy anchor flap (74) and is established during the final folding of blank (218) and wherein a scrap is separated from the blank (218) which causes two triangle-shaped apertures (120A), (120B) to be formed therein without an interconnecting rectangle-shaped aperture (120C).

* * * * *